US012252295B2

(12) United States Patent
Click

(10) Patent No.: US 12,252,295 B2
(45) Date of Patent: Mar. 18, 2025

(54) PAPER-CORE-BASED PALLET AND METHOD FOR CONSTRUCTING THE SAME

(71) Applicant: Daniel Ray Click, Anchorage, KY (US)

(72) Inventor: Daniel Ray Click, Anchorage, KY (US)

( * ) Notice: Subject to any disclaimer, the term of this patent is extended or adjusted under 35 U.S.C. 154(b) by 119 days.

(21) Appl. No.: 18/172,782

(22) Filed: Feb. 22, 2023

(65) Prior Publication Data

US 2023/0264858 A1 Aug. 24, 2023

Related U.S. Application Data

(60) Provisional application No. 63/312,621, filed on Feb. 22, 2022.

(51) Int. Cl.
*B65D 19/00* (2006.01)

(52) U.S. Cl.
CPC ..... *B65D 19/0093* (2013.01); *B65D 2519/00019* (2013.01); *B65D 2519/00054* (2013.01);
(Continued)

(58) Field of Classification Search
CPC ..... B65D 19/0093; B65D 2519/00019; B65D 2519/00054; B65D 2519/00273; B65D 2519/00303; B65D 19/0097; B65D 2519/00293; B65D 2519/00323; B65D 2519/00338; B65D 2519/00348; B65D 2519/00567
See application file for complete search history.

(56) References Cited

U.S. PATENT DOCUMENTS 2,444,326 A * 6/1948 Baker ..... B65D 19/0026 108/55.3
2,463,588 A * 3/1949 Arthur ..... B65D 19/0095 108/52.1
(Continued)

FOREIGN PATENT DOCUMENTS

CN 2835111 Y 11/2006
CN 201545263 U 8/2010
(Continued)

OTHER PUBLICATIONS boxaroundtheworld.com/paper-pallets. "Paper Pallets? What the Hell is That?" Dec. 19, 2018, pp. 1-6.
(Continued)

*Primary Examiner* — Hanh V Tran
(74) *Attorney, Agent, or Firm* — Stites & Harbison, PLLC; Jeffrey A. Haeberlin; Gary N. Stewart

(57) ABSTRACT

A pallet includes a plurality of supports which define a base of a pallet and a plurality of deck rings that are interlocked with the plurality of supports and define a surface of the pallet on which goods in need of transport can be stacked, wherein each support and each deck ring of the pallet is a paper core or a section of a paper core. The supports of the pallet are spaced as to define a base of the pallet and one or more channels for receiving a fork of a lifting device. The supports of the pallet also support the deck rings of the pallet in an elevated position above a ground surface when the supports of the pallet are resting on the ground surface. A method for constructing a pallet is also disclosed.

20 Claims, 6 Drawing Sheets

(52) U.S. Cl.
CPC ..... *B65D 2519/00273* (2013.01); *B65D 2519/00303* (2013.01)

(56) References Cited

U.S. PATENT DOCUMENTS 2,662,710 A * 12/1953 Lapham ..... B65D 19/44 108/52.1
3,131,656 A * 5/1964 Houle ..... B65D 19/0095 D25/156
3,256,839 A * 6/1966 Peterson ..... B65D 19/0073 108/56.1
3,361,092 A 1/1968 Budd
3,654,877 A * 4/1972 Barrett ..... B65D 19/0097 108/56.1
3,683,822 A * 8/1972 Roberts ..... B65D 19/0095 108/56.1
4,228,744 A 10/1980 Moore
5,001,991 A * 3/1991 Smith ..... B65D 19/0095 108/51.3
5,067,418 A * 11/1991 Carter ..... B65D 19/0073 108/56.1
5,119,740 A * 6/1992 Carter ..... B65D 19/0073 108/56.3
5,230,291 A 7/1993 Juvik-Woods
5,269,219 A 12/1993 Juvik-Woods
5,272,990 A * 12/1993 Carter ..... B65D 19/0075 108/56.3
5,329,861 A 7/1994 McCarthy
5,385,103 A 1/1995 Juvik-Woods
5,452,667 A 9/1995 Lim
5,461,988 A 10/1995 Cummings et al.
5,483,899 A * 1/1996 Christie ..... B65D 19/0073 108/901
5,487,345 A * 1/1996 Winebarger ..... B65D 19/0024 108/56.1
5,492,069 A * 2/1996 Alexander ..... B65D 19/0069 108/901
5,495,810 A 3/1996 Yoshii
5,537,937 A 7/1996 Juvik-Woods
5,636,577 A * 6/1997 Gow ..... B65D 19/0095 108/57.17
5,816,172 A * 10/1998 Carter ..... B65D 19/0095 108/56.1
6,012,399 A * 1/2000 Carter ..... B65D 19/0097 108/57.22
8,113,129 B1 * 2/2012 Hurley ..... B65D 19/0028 108/56.3
8,656,843 B2 2/2014 Monteith
9,162,797 B1 * 10/2015 Suiter ..... B65D 19/0018
9,440,770 B2 9/2016 Mueller
10,011,389 B2 * 7/2018 Pang ..... B65D 19/0095
11,807,416 B2 * 11/2023 Furunes ..... B65D 19/004
2006/0102055 A1 * 5/2006 Wu ..... B65D 19/0028 108/51.3
2006/0288913 A1 * 12/2006 Lo ..... B65D 19/0038 108/51.3
2007/0256614 A1 * 11/2007 Chen ..... B65D 19/0069 108/153.1
2008/0127865 A1 * 6/2008 Tung-Cheng ..... B65D 19/12 108/56.3
2008/0210138 A1 9/2008 Ishibashi
2008/0250987 A1 * 10/2008 Hartel ..... B65D 19/0048 108/57.12
2010/0062233 A1 3/2010 Cohen et al.
2010/0175595 A1 * 7/2010 Grietens ..... B65D 19/0095 108/51.3
2010/0224103 A1 9/2010 Ho
2013/0186309 A1 7/2013 Niu
2016/0221714 A1 8/2016 Liao et al.

FOREIGN PATENT DOCUMENTS

CN 108792157 A * 11/2018 ..... B65D 19/0093
CN 108792157 B 5/2020
GB 838909 6/1960
KR 10-2068550 B1 1/2020
WO 01/08987 A1 2/2001
WO WO-2008144854 A1 * 12/2008 ..... B65D 19/0095
WO 2011/108915 A1 9/2011
WO WO-2019068063 A1 * 4/2019 ..... B65D 19/0073

OTHER PUBLICATIONS

Leblanc, R., "Paper Pallets for Export." packagingrevolution.net/paper-pallets-for-export, Jun. 9, 2017, pp. 1-2.
iqsdirectory.com/articles/plastic-pallet/shipping-pallets.html. "Shipping Pallet." pp. 1-34.
signode.com/en-us/productslist/paper-pallets. "Paper Pallets." pp. 1-9.
Korean Intellectual Property Office, International Search Report and Written Opinion issued in corresponding Application No. PCT/US2023/063027, mailed Jun. 9, 2023.

* cited by examiner

PAPER-CORE-BASED PALLET AND METHOD FOR CONSTRUCTING THE SAME

CROSS-REFERENCE TO RELATED APPLICATION

The present application claims priority to U.S. Patent Application Ser. No. 63/312,621 filed on Feb. 22, 2022, the entire disclosure of which is incorporated herein by reference.

BACKGROUND OF THE INVENTION

The present invention relates to the field of transport structures for supporting goods during transit. In particular, the present invention relates to a pallet constructed of interlocking paper cores and/or sections of paper cores and a method of constructing the same.

A pallet is a flat transport structure on which goods may be stacked in a stable fashion while being lifted by a fork lift, a pallet jack, a front loader, erect crane, or the like. Traditionally, pallets have been constructed of wooden boards, which are held together with nails or other fasteners. The presence of such fasteners can be problematic, however, with respect to the ability of such pallets being easily recycled as the material of the fasteners can inhibit or otherwise adversely affect certain components of recycling systems. The wooden boards utilized in traditional pallets are typically pressure treated and kiln dried. Such treatment often leads to splintering and other wood fiber shedding, which can cause contamination when such pallets are used to transport food and pharmaceutical products.

To facilitate transport, pallets typically have openings at one or more ends for receiving lifting forks, and have standardized sizes to provide uniformity during loading and storing operations. For instance, one commonly sized wooden pallet is 40"×48", which costs approximately $20-$25 USD. As transportation of such pallets costs about the same as the value of the pallets themselves, recirculation and reuse of such pallets is uneconomical. As a result, large amounts of waste is created from the use of traditional pallets. Further, a service fee must typically be paid for used traditional pallets to be properly disposed of.

Although alternative pallet constructions have been proposed, they are typically more expensive to manufacture than wooden pallets. For instance, plastic pallets typically cost two to three times as much as wooden pallets, and corrugated, honeycomb, and molded pulp cardboard stock pallets cost about twice as much as wooden pallets and require custom tooling for manufacturing.

BRIEF SUMMARY OF THE INVENTION

In accordance with one aspect of the invention, a pallet includes a plurality of supports which define a base of a pallet and a plurality of deck rings that are interlocked with the plurality of supports and define a surface of the pallet on which goods in need of transport can be stacked, wherein each support and each deck ring of the pallet being a paper core or a section of a paper core. The supports of the pallet are spaced as to define a base of the pallet and one or more channels for receiving a fork of a lifting device and support the plurality of deck rings in an elevated position above a ground surface when the supports of the pallet are resting on the ground surface.

In some embodiments, the supports of the pallet are configured to support the plurality of deck rings in an upright position above the ground surface, such that a longitudinal axis of each deck ring is perpendicular to the ground surface when the plurality of supports are resting on the ground surface. To this end, and in some embodiments, each support of the pallet defines a plurality of notches for receiving one or more of the deck rings, where each notch extends transverse to a curvature of the support defining the notch. In some embodiments, each support of the pallet defines at least two notches in which a single deck ring of the pallet is received. In some embodiments, at least one of the supports of the pallet is interlocked with at least two deck rings of the pallet. In some embodiments, each deck ring of the pallet is interlocked with another deck ring of the pallet.

In some embodiments, the pallet further includes one or more central connectors centrally positioned about the pallet and interlocked with multiple deck rings of the pallet, wherein each central connector is a paper core or a section of a paper core. In such embodiments, the one or more central connectors are of a height which is shorter than the height of the supports of the pallet. To facilitate the interlocking of each central connector with multiple deck rings of the pallet, each central connector defines a plurality of notches which extend transverse to a curvature of the central connector. In some embodiments, each deck ring of the pallet defines a plurality of notches for receiving at least one of a support of the pallet, another deck ring of the pallet, and a central connector of the pallet. In one such embodiment, the plurality of notches defined by each deck ring extends transverse to a curvature of the deck ring. In some embodiments, each central connector of the pallet is interlocked with each deck ring of the pallet. In some embodiments, the pallet includes multiple central connectors which are interlocked with each other. In some embodiments, the pallet may include a central connector which defines a notch configured to receive two deck rings of the pallet. Advantageously, interlocking the components may be made by press-fit (or friction-fit) connections, without the use of fasteners or additional glue, thus making the pallet even more suitable for recycling or inclusion in a recycling stream.

To provide a level surface across the entirety of the top of the pallet, in some embodiments, the top surface of each respective component of the pallet is coplanar with the top surface of the other components of the pallet and is a flat surface. To avoid the use of articles which could adversely affect recycling systems in instances where the pallet is recycled, the interlocked components of the pallet are preferably interlocked together without the use of fasteners or adhesives.

According to another aspect of the invention, a method for constructing a pallet includes: positioning a first set of components of a first height as to define a base of the pallet and one or more channels in which a fork of a lifting device can be received, wherein each component of the first set of components is a paper core or a section of a paper core; and interlocking a second set of components of a second height with the first set of components, such that a flat, top surface of each of the first set of components and a flat, top surface of each of the second set of components is coplanar, wherein each component of the second set of components is a paper core or a section of a paper core and the second height is shorter than the first height.

BRIEF DESCRIPTION OF THE DRAWINGS

These and other features, aspects, and advantages of the present invention will become better understood with regard to the following description, appended claims, and accompanying drawings where:

DETAILED DESCRIPTION OF EXEMPLARY EMBODIMENTS OF THE INVENTION

Figure 1:
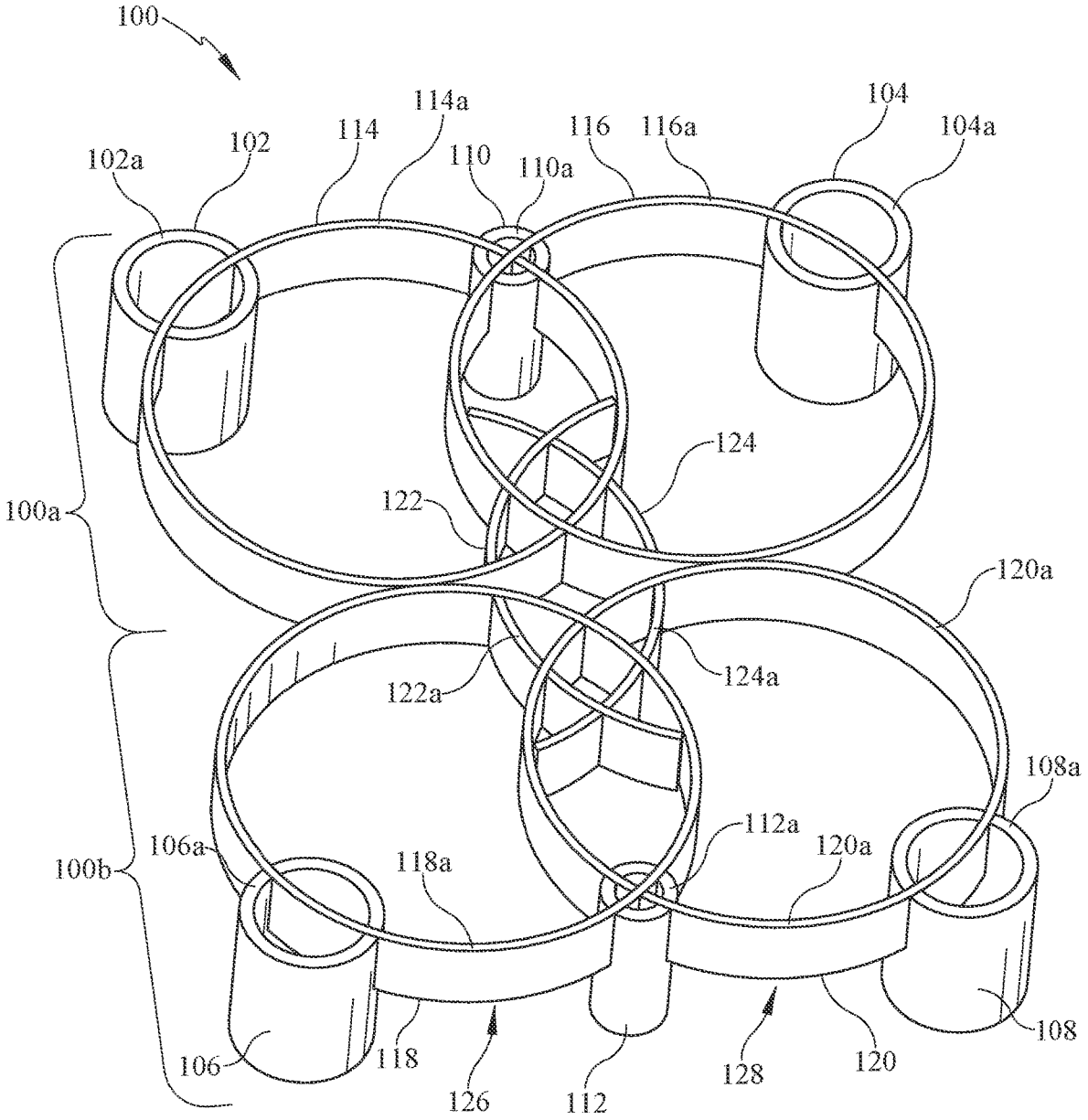
FIG. 1 is a perspective view of an exemplary pallet made in accordance with the present invention.

The details of one or more embodiments of the presently-disclosed subject matter are set forth below. Modifications to embodiments described below, and other embodiments, will be evident to those of ordinary skill in the art after a study of the present disclosure. The specific details of the described exemplary embodiments are provided primarily for clearness of understanding and no unnecessary limitations are to be understood therefrom. In case of conflict, the specification of this document, including definitions, will control.

While the terms used herein are believed to be well understood by one of ordinary skill in the art, definitions are set forth herein to facilitate explanation of the presently-disclosed subject matter.

Unless defined otherwise, all technical and scientific terms used herein have the same meaning as commonly understood by one of ordinary skill in the art to which the presently-disclosed subject matter belongs. Although any methods, devices, and materials similar or equivalent to those described herein can be used in the practice or testing of the presently-disclosed subject matter, representative methods, devices, and materials are now described.

Following long-standing patent law convention, the terms "a," "an," and "the" refer to "one or more" when used in this application, including the claims.

The terms "comprising," "including," and "having" are intended to be inclusive and mean that there may be additional elements other than the listed elements.

As used herein, "paper core" is understood to mean a tubular or circular structure which includes multiple paper sheet layers wound together and held in place (e.g., via a liquid adhesive, such as glue, between the respective paper sheet layers) as to maintain the shape of the tubular or circular structure. The paper cores or sections of paper cores from which the various components of the exemplary pallets described herein are constructed may, in some embodiments, comprise recycled materials and/or be sourced from an existing paper core structure. For instance, in some embodiments, the paper cores and/or sections of paper cores from which the various components of the exemplary pallets described herein may be, or be sourced from, one or more paper cores previously used to hold a stock material, such as plastic film, paper, yarn, and the like. In this regard, embodiments of the present disclosure take advantage of, and provide a secondary use for, existing commercial materials which may otherwise be discarded. It should be appreciated, however, that the paper cores or sections of paper cores from which the various components of the exemplary pallets described herein are not strictly limited to recycled or existing materials. Rather, embodiments are also contemplated herein in which the paper cores or sections of paper cores from which the various components of the exemplary pallets described herein are constructed are newly fabricated.

As used herein, the term "support," when referred to in the context of being a component of a pallet, is understood to mean a component which partially defines a base of the pallet and is configured to support one or more deck rings of the pallet in an elevated position above a ground surface.

In the present disclosure, reference is sometimes made to a notch defined by one component "corresponding" to a notch defined by another component. In such instances, it is appreciated that "corresponding" notches refer to two notches, of which one notch is defined by a first component of a pallet (e.g., a support) and the other notch is defined by a second component of the pallet (e.g., another support or a deck ring), and which are aligned prior to the first component and the second component of the pallet being press fit together.

Figure 2:
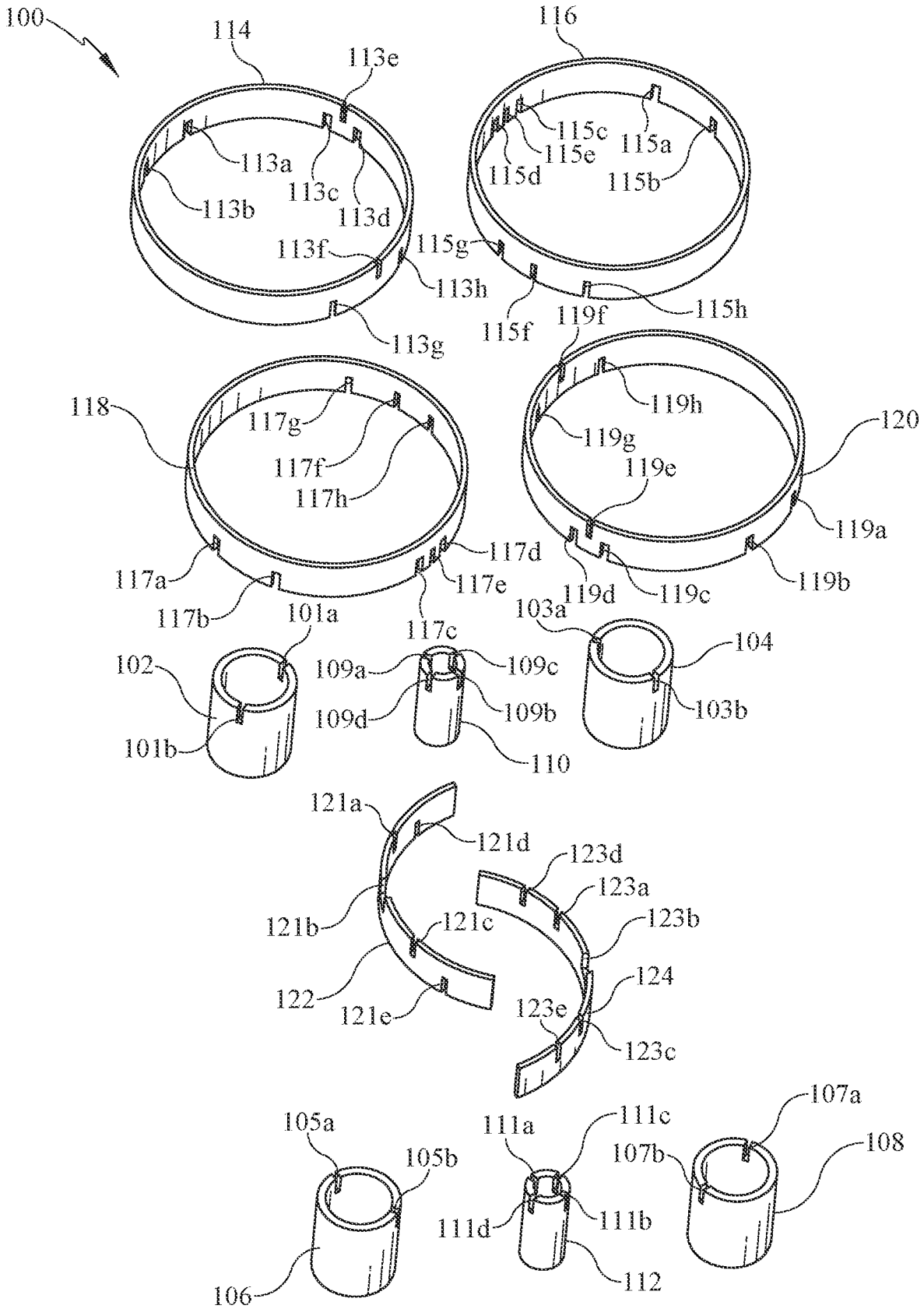
FIG. 2 is an exploded view of the exemplary pallet of FIG. 1.
Figure 3:
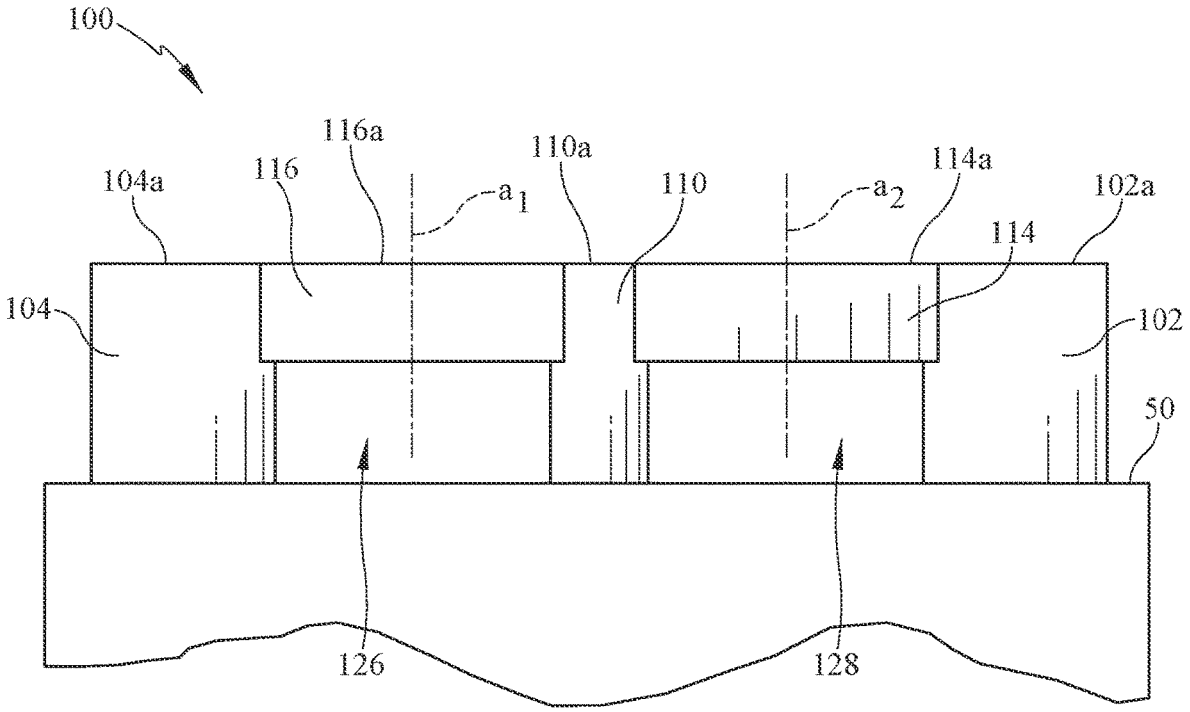
FIG. 3 is a side view of the exemplary pallet of FIG. 1.

FIGS. 1-3 show various views of an exemplary pallet 100 made in accordance with the present invention. As shown in FIGS. 1-3, in this exemplary embodiment, the pallet 100 includes: a plurality of supports 102, 104, 106, 108, 110, 112 which define a base of the pallet 100; and a plurality of deck rings 114, 116, 118, 120, which are interlocked with the plurality of supports 102, 104, 106, 108, 110, 112 and define a surface of the pallet 100 upon which goods in need of transport can be stacked. The respective supports of the plurality of supports 102, 104, 106, 108, 110, 112 are spaced as to define one or more channels 126, 128 for receiving a fork (not shown) of a lifting device (not shown), such as a fork lift, a pallet jack, a front loader, erect crane, or the like. In this exemplary embodiment, the pallet 100 further includes one or more central connectors 122, 124 that are centrally positioned about the pallet 100 and interlocked with multiple deck rings of the plurality of deck rings 114, 116, 118, 120 to maintain a first portion 100*a* and a second portion 100*b* of the pallet 100 in association with each other.

Referring still to FIGS. 1-3, the plurality of supports 102, 104, 106, 108, 110, 112 support the plurality of deck rings 114, 116, 118, 120 in an elevated and upright position above a ground surface 50 (FIG. 3) when the plurality of supports 102, 104, 106, 108, 110, 112 are resting on the ground surface 50 to provide clearance for the fork(s) of the lifting device to be inserted into the one or more channels 126, 128 beneath one or more of the deck rings 114, 116, 118, 120. To this end, the plurality of deck rings 114, 116, 118, 120 are of a shorter height than the plurality of supports 102, 104, 106, 108, 110, 112 defining the base of the pallet 100. In this exemplary embodiment, the one or more central connectors 122, 124 are also of a shorter height than the plurality of supports 102, 104, 106, 108, 112 defining the base of the pallet 100, and thus are also elevated above the ground surface 50 by virtue of being interlocked with multiple deck rings of the plurality of deck rings 114, 116, 118, 120. Advantageously, the plurality of supports 102, 104, 106, 108, 110, 112, the plurality of deck rings 114, 116, 118, 120, and the one or more central connectors 122, 124 are each a paper core or a section of a paper core to provide a more environmentally friendly and cost-effective alternative to known pallet constructions. Additionally, further driving cost-efficiency, the plurality of deck rings 114, 116, 118, 120 and the one or more central connectors 122, 124 may be formed from the same size paper core stock, with the central connectors 122, 124 having an arc length of approximately ⅓ (i.e., a 120" central angle) of the circumference of the paper core stock used for the plurality of deck rings 114, 116, 118, 120.

Referring still to FIGS. 1-3, in this exemplary embodiment, the base of the pallet 100 is defined by a total of six supports: a first support 102; a second support 104; a third support 106; a fourth support 108; a fifth support 110; and a sixth support 112. As shown best in FIG. 1, in this exemplary embodiment, the first support 102, the second support 104, the third support 106; and the fourth support 108 are positioned at the corners of the pallet 100 and thus may also be characterized as "corner supports." As further shown in FIG. 1, the fifth support 110 and the sixth support 112 are positioned between the first support 102 and the second support 104 and between the third support 106 and the fourth support 108, respectively, and may thus be characterized as "middle supports." In this exemplary embodiment, the number of deck rings within the pallet 100 corresponds to the number of corner supports 102, 104, 106, 108. Accordingly, in this case, the pallet 100 includes four deck rings: a first deck ring 114; a second deck ring 116; a third deck ring 118; and a fourth deck ring 120. As shown, in this exemplary embodiment, each respective support 102, 104, 106, 108, 110, 112 and each respective deck ring 114, 116, 118, 120 is a paper core.

Referring still to FIGS. 1-3, the plurality of supports 102, 104, 106, 108, 110, 112 are interlocked with the plurality of deck rings 114, 116, 118, 120 via a series of press-fit (or friction-fit) connections. In the exemplary embodiments described herein, the press-fit connections may be achieved by making the notches (described below) 0.050" smaller than the thickness of the respective material received therein, such that the connections are made without the use of fasteners or additional glue. Thus, each respective support 102, 104, 106, 108, 110, 112 defines, and thus may also be characterized as including, a plurality of notches for receiving one or more of the deck rings 114, 116, 118, 120 therein. As best shown in FIG. 2, each respective notch in each respective support 102, 104, 106, 108, 110, 112 extends transverse to the curvature of the support 102, 104, 106, 108, 110, 112. As a result of such notch orientation, the deck rings 114, 116, 118, 120 are able to be received and maintained in an upright position by the supports 102, 104, 106, 108, 110, 112, such that a longitudinal axis, $a_1$, $a_2$, of each respective deck ring 114, 116, 118, 120 is perpendicular to the ground surface 50 when the supports 102, 104, 106, 108, 110, 112 are resting on the ground surface 50, as shown in FIG. 3. In this exemplary embodiment, each respective deck ring 114, 116, 118, 120 also defines, and thus may also be characterized as including, a plurality of notches, with each respective notch of each respective deck ring 114, 116, 118, 120 receiving a support, a deck ring, or a central connector therein, as further described below. As in the supports 102, 104, 106, 108, 110, 112, the notches defined by each respective deck ring 114, 116, 118, 120 extend transverse to the curvature of the deck ring 114, 116, 118, 120, as best shown in FIG. 2. The notches defined by the supports 102, 104, 106, 108, 110, 112 and the deck rings 114, 116, 118, 120 can be established by removing a portion of the paper core defining such components using known cutting, sawing, and/or punching means.

Referring now specifically to FIGS. 1 and 2, the first support 102, the second support 104, and the fifth support 110 are interlocked with the first deck ring 114 and/or the second deck ring 116 to define a first portion 100*a* of the pallet 100. Specifically, in forming the first portion 100*a* of the pallet 100: the first support 102 is interlocked with the first deck ring 114; the second support 104 is interlocked with the second deck ring 116; and the fifth support 110 is interlocked with both the first deck ring 114 and the second deck ring 116. In this exemplary embodiment, the interlocking of the first support 102 with the first deck ring 114 is achieved by aligning a first notch 101*a* and a second notch 101*b* defined by the first support 102 with a first notch 113*a* and a second notch 113*b*, respectively, defined by the first deck ring 114 and press fitting the first support 102 and the first deck ring 114 together. The second support 104 and the second deck ring 116 are similarly interlocked, in this exemplary embodiment, by aligning a first notch 103*a* and a second notch 103*b* defined by the second support 104 with a first notch 115*a* and a second notch 115*b*, respectively, defined by the second deck ring 116 and press fitting the second support 104 and the second deck ring 116 together. The first deck ring 114 and the fifth support 110 are interlocked, in this exemplary embodiment, by aligning a first notch 109*a* and a second notch 109*b* defined by the fifth support 110 with a third notch 113*c* and a fourth notch 113*d*, respectively, defined by the first deck ring 114 and press fitting the fifth support 110 and the first deck ring 114 together. The second deck ring 116 and the fifth support 110 are interlocked, in this exemplary embodiment, by aligning a third notch 109*c* and a fourth notch 109*d* defined by the fifth support 110 with a third notch 115*c* and a fourth notch 115*d*, respectively, defined by the second deck ring 116 and press fitting the fifth support 110 and the second deck ring 116 together.

Referring still to FIGS. 1 and 2, in this exemplary embodiment, the first deck ring 114 and the second deck ring 116 are interlocked with the fifth support 110 in a manner which causes the first deck ring 114 and the second deck ring 116 to overlap. Specifically, and as shown best in FIG. 1, the first deck ring 114 and the second deck ring 116 overlap at a first point located at the center of the fifth support 110 and a second point adjacent to the center of the pallet 100. As further shown in FIG. 1, the first deck ring 114 and the second deck ring 116 are interlocked at these points of overlap by aligning a fifth notch 113*e* and a sixth notch 113*f* defined by the first deck ring 114 with a fifth notch 115*e* and a sixth notch 115*f*, respectively, defined by the second deck ring 116 and press fitting the first deck ring 114 and the second deck ring 116 together.

Referring still to FIGS. 1 and 2, the third support 106, the fourth support 108, and the sixth support 112 are interlocked with the third deck ring 118 and/or the fourth deck ring 120 to define a second portion 100*b* of the pallet 100. Specifically, in forming the second portion 100*b* of the pallet 100: the third support 106 is interlocked with the third deck ring 118; the fourth support 108 is interlocked with the fourth deck ring 120; and the sixth support 112 is interlocked with both the third deck ring 118 and the fourth deck ring 120.

Referring still to FIGS. 1 and 2, in this exemplary embodiment, the interlocking of the third support 106 with the third deck ring 118 is achieved by aligning a first notch 105*a* and a second notch 105*b* defined by the third support 106 with a first notch 117*a* and a second notch 117*b*, respectively, defined by the third deck ring 118 and press fitting the third support 106 and the third deck ring 118 together. The fourth support 108 and the fourth deck ring 120 are similarly interlocked, in this exemplary embodiment, by aligning a first notch 107*a* and a second notch 107*b* defined by the fourth support 108 and a first notch 119*a* and a second notch 119*b*, respectively, defined by the fourth deck ring 120 and press fitting the fourth support 108 and the fourth deck ring 120 together. The third deck ring 118 and the sixth support 112 are interlocked, in this exemplary embodiment, by aligning a first notch 111*a* and a second notch 111*b* defined by the sixth support 112 with a third notch 117*c* and a fourth notch 117*d*, respectively, defined by the third deck ring 118 and press fitting the sixth support 112 and the third deck ring 118 together. The sixth support 112 and the fourth deck ring 120 are interlocked, in this exemplary embodiment, by aligning a third notch 111*c* and a fourth notch 111*d* defined by the sixth support 112 with a third notch 119*c* and a fourth notch 119*d*, respectively, defined by the fourth deck ring 120 and press fitting the sixth support 112 and the fourth deck ring 120 together.

Referring still to FIGS. 1 and 2, in this exemplary embodiment, the third deck ring 118 and the fourth deck ring 120 are interlocked with the sixth support 112 in a manner which causes the third deck ring 118 and the fourth deck ring 120 to overlap. Specifically, and as shown best in FIG. 1, the third deck ring 118 and the fourth deck ring 120 overlap at a third point located at the center of the sixth support 112 and a fourth point adjacent to the center of the pallet 100. As further shown in FIG. 1, the third deck ring 118 and the fourth deck ring 120 are interlocked at these points of overlap by aligning a fifth notch 117*e* and a sixth notch 117*f* defined by the third deck ring 118 with a fifth notch 119*e* and a sixth notch 119*f*, respectively, defined by the fourth deck ring 120 and press fitting the third deck ring 118 and the fourth deck ring 120 together. In this exemplary embodiment, the points of overlap of the first deck ring 114 and the second deck ring 116 and of the third deck ring 118 and the fourth deck ring 120 are all linearly arranged when the pallet 100 is assembled.

As reflected in the discussion above, when the first portion 100*a* and the second portion 100*b* of the pallet 100 are assembled: the notches of the four corner supports 102, 104, 106, 108 of the pallet 100 (i.e., the first support 102, the second support 104, the third support 106, and the fourth support 108) each interlock with and support a single one of the deck rings 114, 116, 118 120; the middle supports 110, 112 of the pallet 100 (i.e., the fifth support 110 and the sixth support 112) each interlock with and support two of the deck rings 114, 116, 118, 120; and each deck ring 114, 116, 118, 120 is interlocked with another deck ring 114, 116, 118, 120.

Referring now again to FIGS. 1 and 2, as noted above, the first portion 100*a* and the second portion 100*b* of the pallet 100 are maintained in association with each other by the one or more central connectors 122, 124, which, in this exemplary embodiment, there are two: a first central connector 122; and a second central connector 124. As shown, in this exemplary embodiment, the first central connector 122 and the second central connector 124 are each a section, and, more specifically, an arc section of a paper core. To maintain the first portion 100*a* and the second portion 100*b* of the pallet 100 in association with each other, the first central connector 122 and the second central connector 124 are each configured to interlock with and interconnect multiple deck rings 114, 116, 118, 120 together. Specifically, in this exemplary embodiment, the first central connector 122 and the second central connector 124 are each configured to interlock with and interconnect each of the deck rings 114, 116, 118, 120 together. To this end, the first central connector 122 defines, and may thus be characterized as including: a first notch 121*a* in which the second deck ring 116 is received; a second notch 121*b* in which both the first deck ring 114 and the third deck ring 118 are received; and a third notch 121*c* in which the fourth deck ring 120 is received. The second central connector 124 similarly defines, and may thus be characterized as including: a first notch 123*a* in which the first deck ring 114 is received; a second notch 123*b* in which both the second deck ring 116 and the fourth deck ring 120 are received; and a third notch 123*c* in which the third deck ring 118 is received. As the second notches 121*b*, 123*b* defined by the first central connector 122 and the second central connector 124 are configured to receive two of the deck rings therein, the second notches 121*b*, 123*b* are, in this exemplary embodiment, wider than the first notches 121*a*, 123*a* and the third notches 121*c*, 123*c* defined by the first central connector 122 and the second central connector 124. Although not illustrated within the drawings, embodiments in which the first central connector 122 defines two separate notches for receiving the first deck ring 114 and the third deck ring 118, as well as embodiments in which the second central connector 124 defines two separate notches for receiving the second deck ring 116 and the fourth deck ring 120 are also contemplated herein. The first central connector 122 and the second central connector 124 each also define, in this exemplary embodiment, a fourth notch 121*d*, 123*d* and a fifth notch 121*e*, 123*e*, the importance of which is further discussed below. Each notch defined by the first central connector 122 and the second central connector 124 extend transverse to the curvature of the central connector by which it is defined. As with the notches of the supports 102, 104, 106, 108, 110, 112 and deck rings 114, 116, 118, 120, the notches defined by the first central connector 122 and the second central connector 124 can be established by removing a portion of the paper core section defining such components using known cutting, sawing, and/or punching means.

Referring still to FIGS. 1 and 2, to facilitate interlocking with the first central connector 122 and the second central connector 124, the first deck ring 114, the second deck ring 116, the third deck ring 118, and the fourth deck ring 120 each further define a seventh notch 113*g*, 115*g*, 117*g*, 119*g* and an eighth notch 113*h*, 115*h*, 117*h*, 119*h* in which the first central connector 122 or the second central connector 124 is received. The interlocking of the first central connector 122 with the second deck ring 116 is achieved, in this exemplary embodiment, by aligning the first notch 121*a* defined by the first central connector 122 with the seventh notch 115*g* defined by the second deck ring 116 and press fitting the first central support 122 and the second deck ring 116 together. The first central connector 122 is interlocked with the first deck ring 114 and the third deck ring 118, in this exemplary embodiment, by aligning the second notch 121*b* defined by the first central connector 122 with both the seventh notch 113*g* defined by the first deck ring 114 and the seventh notch 117*g* defined by the third deck ring 118 and press fitting the first central connector 122 together with the first deck ring 114 and the third deck ring 118. The first central connector 122 and the fourth deck ring 120 are interlocked, in this exemplary embodiment, by aligning the third notch 121*c* defined by the first central connector 122 and the seventh notch 119*g* defined by the fourth deck ring 120 and press fitting the first central connector 122 and the fourth deck ring 120 together.

Referring still to FIGS. 1 and 2, the second central connector 124 and the first deck ring 114 are interlocked, in this exemplary embodiment, by aligning the first notch 123*a* defined by the second central connector 124 and the eighth notch 113*h* defined by the first deck ring 114 and press fitting the second central connector 124 and the first deck ring 114 together. The second central connector 124 is interlocked with the second deck ring 116 and the fourth deck ring 120, in this exemplary embodiment, by aligning the second notch 123*b* defined by the second central connector 124 with both the eighth notch 115*h* defined by the second deck ring 116 and the eighth notch 119*h* defined by the fourth deck ring 120 and press fitting the second central connector 124 together with the second deck ring 116 and the fourth deck ring 120. The second central connector 124 is interlocked with the third deck ring 118, in this exemplary embodiment, by aligning the third notch 123*c* defined by the second central connector 124 with the eighth notch 117*h* defined by the third deck ring 118 and press fitting the second central connector 124 and the third deck ring 118 together.

Referring still to FIGS. 1 and 2, in this exemplary embodiment, the first central connector 122 and the second central connector 124 are interlocked with the first deck ring 114, the second deck ring 116, the third deck ring 118, and the fourth deck ring 120 in a manner which causes the first central connector 122 and the second central connector 124 to overlap. Specifically, and as shown best in FIG. 1, the first central connector 122 and the second central connector 124 overlap at a first point within an intersection of the first deck ring 114 and the second deck ring 116 and at a second point within an intersection of the third deck ring 118 and the fourth deck ring 120. The first central connector 122 and the second central connector 124 are interlocked, in this exemplary embodiment, at these points by aligning the fourth notch 121*d* and the fifth notch 121*e* defined by the first central connector 122 with the fourth notch 123*d* and the fifth notch 123*e*, respectively, defined by the second central connector 124 and press fitting the first central connector 122 and the second central connector 124 together. In this exemplary embodiment, the first central connector 122 and the second central connector 124 are each of a shorter height than the supports 102, 104, 106, 108, 110, 112, and, as such, like the deck rings 114, 116, 118, 120, are supported in an elevated position above the ground surface 50 (FIG. 13) when the supports 102, 104, 106, 108, 110, 112 are resting on the ground surface 50.

To ensure the various components of the pallet 100 which are interlocked together are closely fitted (or "snug"), it is generally preferred that the width of each of the above-discussed notches is smaller than the thickness of the portion of the component, or, in the case of the second notches 121*b*, 123*b* defined by the first central connector 122 and the second central connector 124, smaller than the combined thickness of the portions of the two components, intended to be received in the notch. For example, in some embodiments, the width of each notch may be approximately 10% smaller than the thickness of the portion of the component or the combined thickness of the components intended to be received therein. As the notches described herein are initially formed by removing a portion of the paper core or paper core section by which the notches are defined using known cutting, sawing, and/or punching means, it should be appreciated that the widths and depths of each respective notch in the pallet 100 can be easily modified to better accommodate certain applications or environments.

The interlocking arrangement facilitated by the corresponding notches of the supports 102, 104, 106, 108, 110, 112, the deck rings 114, 116, 118, 120, and the central connectors 122, 124, in conjunction with the width of such notches aids in limiting translational movement of: the deck rings 114, 116, 118, 120 relative to the supports 102, 104, 106, 108, 110, 112 with which they are interlocked; the deck rings 114, 116, 118, 120 relative to each other; the deck rings 114, 116, 118, 120; the deck rings 114, 116, 118, 120 relative to the central connectors 122, 124 with which they are interlocked; and the central connectors 122, 124 relative to each other while the pallet 100 is in use.

Once the assembled first portion 100*a* and the assembled second portion 100*b* of the pallet 100 are connected by the first central connector 122 and the second central connector 124 and the first central connector 122 and the second central connector 124 are interlocked together, the pallet 100 is considered to be in a fully assembled state and ready for use. In this exemplary embodiment, when the pallet 100 is an assembled state, each respective notch defined by one component of the pallet 100 is vertically positioned relative to another corresponding notch defined by another component of the pallet 100. As reflected in the discussion above, the notches within the respective component of the pallet 100 enable the pallet 100 to be fully assembled by press fitting, and thus without the use of fasteners (screws, nails, staples, and the like) or adhesives, while still being as structurally strong as a traditional wooden pallet. That is: the supports 102, 104, 106, 108, 110, 112 can be interlocked with the deck rings 114, 116, 118, 120; the deck rings 114, 116, 118, 120 can be interlocked with each other and to the first central connector 122 and the second central connector 124; and the first central connector 122 and the second central connector 124 can be interlocked with each other, without the use of fasteners (screws, nails, staples, and the like) or adhesives.

Referring now to FIGS. 1 and 3, to provide a level surface across the entirety of the top of the pallet 100 upon which goods in need of transport can rest, in this exemplary embodiment, the supports 102, 104, 106, 108, 110, 112 are of equal height, and the deck rings 114, 116, 118, 120 and central connectors 122, 124 are of equal height. Further to this end, in this exemplary embodiment, the top surface 102*a*, 104*a*, 106*a*, 108*a*, 110*a*, 112*a*, 114*a*, 116*a*, 118*a*, 120*a*, 122*a*, 124*a* of each respective component of the pallet 100 described above (i.e., the supports 102, 104, 106, 108, 110, 112, the deck rings 114, 116, 118, 120, and the central connectors 122, 124) is coplanar with (i.e., resides along substantially the same plane as) the top surface 102*a*, 104*a*, 106*a*, 108*a*, 110*a*, 112*a*, 114*a*, 116*a*, 118*a*, 120*a*, 122*a*, 124*a* of the other components of the pallet 100 and is a flat surface. To permit the top surface 102*a*, 104*a*, 106*a*, 108*a*, 110*a*, 112*a*, 114*a*, 116*a*, 118*a*, 120*a*, 122*a*, 124*a* of these components to reside along a common plane when the pallet 100 is assembled, in this exemplary embodiment: each notch defined by one of the deck rings 114, 116, 118, 120 extends approximately 50% of the height of the deck ring defining the notch; each notch defined by one of the supports 102, 104, 106, 108, 110, 112 extends approximately 21% of the height of the support defining the notch; and each notch defined by one of the central connectors 122, 124 extends approximately 50% of the height of the central connector defining the notch.

Referring now again to FIGS. 1-3, in this exemplary embodiment, the respective components of the pallet 100 are of the dimensions specified in Table 1 below. These values are exemplary, in that for heavier loads greater thickness and height of the components can be used to create a stronger pallet, and for lighter loads lesser thickness and height of the components can be used to create a more economical pallet, all while maintaining the overall standard dimensions (40"× 48" with a 4" fork clearance and a 12" fork channel width) of the pallet.

TABLE 1

| PALLET COMPONENT | HEIGHT | OUTER DIAMETER | ARC LENGTH | THICK-NESS |
|---|---|---|---|---|
| Corner Supports (102, 104, 106, 108) | 7 inches | 6 inches | — | 0.75 inches |
| Middle Supports (110, 112) | 7 inches | 3 inches | — | 0.75 inches |

TABLE 1-continued

| PALLET COMPONENT | HEIGHT | OUTER DIAMETER | ARC LENGTH | THICK-NESS |
|---|---|---|---|---|
| Deck Rings (114, 116, 118, 120) | 3 inches | 24 inches | — | 0.75 inches |
| Central Connectors (122, 124) | 3 inches | 24 inches | approx. 25 inches (120° central angle) | 0.75 inches |

Referring still to FIGS. 1-3, the assembled pallet 100, in this exemplary embodiment, has dimensions of 40 inches× 48 inches×7 inches and provides a 4 inch clearance under the deck rings 114, 116, 118, 120 and two 6-inch wide channels 126, 128 for receiving the forks of a lifting device. Of course, as evidenced by the pallet embodiments 200, 300 described below with reference to FIGS. 4-6, the dimensions and/or number of supports, deck rings, and/or central connectors may vary from that of the pallet 100 described above with reference to FIGS. 1-3 to better accommodate different applications and/or environments. One of ordinary skill in the art will thus appreciate that, in instances where the dimensions of the supports, deck rings, and/or central connectors vary from that of the pallet 100 described above with reference to FIGS. 1-3, the extent to which the above-described notches defined by the supports 102, 104, 106, 108, 110, 112, deck rings 114, 116, 118, 120, and/or central connectors 122, 124 extend along the height of such components may vary from that described above without departing from the spirit and scope of the present invention. For instance, in embodiments where the height of the supports 102, 104, 106, 108, 110, 112 is greater than that specified in TABLE 1 above and the height of the deck rings 114, 116, 118, 120 remains the same, the notches defined by the supports 102, 104, 106, 108, 110, 112 for receiving the deck rings 114, 116, 118, 120 may extend less than 21% of the total height of the supports 102, 104, 106, 108, 110, 112. One of ordinary skill in the art, will appreciate that, in assembling the pallet 100, the various components of the pallet 100 may be interlocked together in a different order than that discussed above. Indeed, except where context precludes otherwise, the various components of the pallet 100 can be assembled in any order by aligning the corresponding notches defined by corresponding components of the pallet 100 and press fitting such components together.

Figure 4:
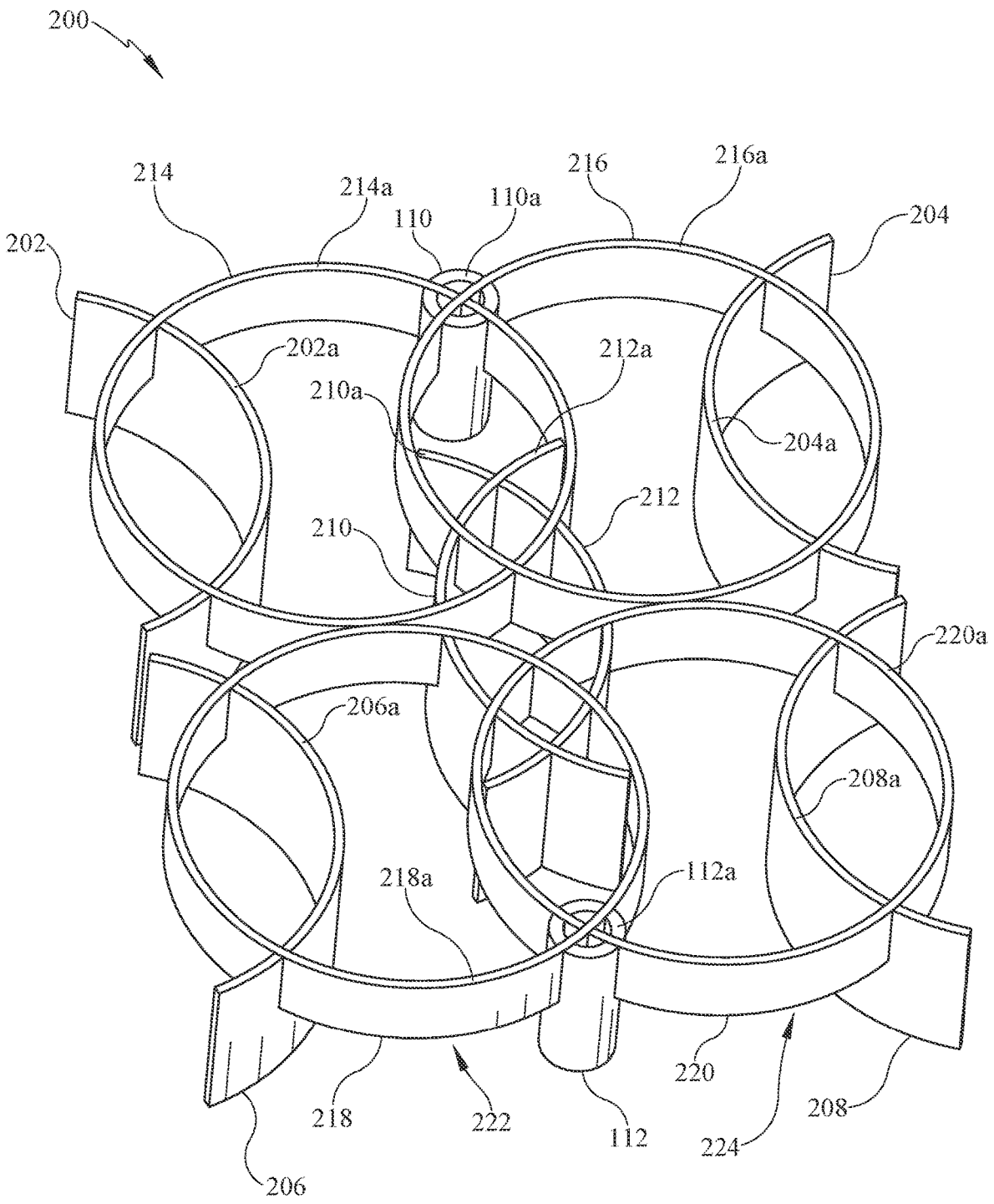
FIG. 4 is a perspective view of another exemplary pallet made in accordance with the present invention.
Figure 5:
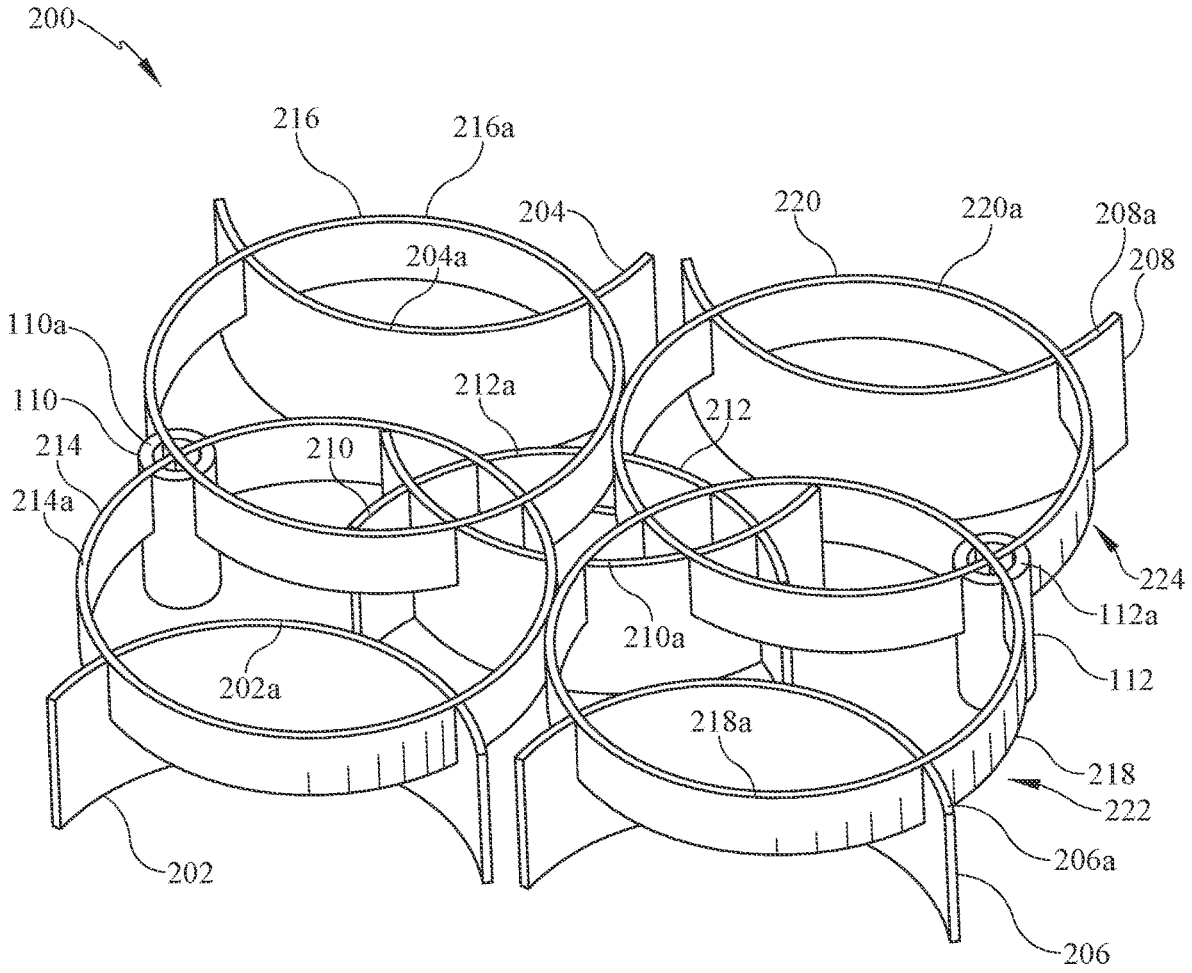
FIG. 5 is another perspective view of the exemplary pallet of FIG. 4.

FIGS. 4 and 5 show various perspective views of another exemplary pallet 200 made in accordance with the present invention. In this exemplary embodiment, the pallet 200 is of similar construction to the pallet 100 described above with reference to FIGS. 1-3, except that: (i) the four corner supports 102, 104, 106, 108 are substituted with four side supports 202, 204, 206, 208 defined by arc sections taken from a paper core; (ii) the spacing of the notches defined by the deck rings 214, 216, 218, 220 is altered relative to the spacing of the notches defined by the deck rings 114, 116, 118, 120 of the pallet 100 described above with reference to FIGS. 1-3; and (iii) instead of two central connectors centrally positioned about the pallet 200, there are, instead, two additional supports 210, 212, which, in this case, are also arc sections taken from a paper core. Thus, in this exemplary embodiment, instead of there being six supports, there are a total of eight supports: a first support 202; a second support 204; a third support 206; a fourth support 208; a fifth support 110; a sixth support 112; a seventh support 210; and an eighth support 212. It should be appreciated that throughout the present disclosure, like components are provided with like reference numerals.

Referring still to FIGS. 4 and 5, as shown, the first support 202 and the third support 206 are positioned as to define a first side of the base of the pallet 200 and the second support 204 and the fourth support 208 are positioned as to define a second side of the pallet 200. As such, the first support 202, the second support 204, the third support 206, and the fourth support 208 may also be characterized as "side supports." As further shown, the fifth support 110 and the sixth support 112 are positioned between the first support 202 and the second support 204 and between the third support 206 and the fourth support 208, respectively, and may thus also be characterized as "middle supports." As further shown, the seventh support 210 and the eighth support 212 are positioned about the pallet 200 in similar fashion as the first central connector 122 and the second central connector 124 of the pallet 100 described above with reference to the pallet 100 shown in FIGS. 1 and 2, and thus may also be characterized as a "first central support" and a "second central support," respectively. In this exemplary embodiment, the arc sections defining the side supports 202, 204, 206, 208 of the pallet 200 are taken from paper cores having an outer diameter of approximately 24 inches. The first deck ring 214, the second deck ring 216, the third deck ring 218, and the fourth deck ring 220 are of similar construction to the first deck ring 114, the second deck ring 116, the third deck ring 118, and the fourth deck ring 120, respectively, of the pallet 100 described above with reference to FIGS. 1-3, except that the spacing of the notches configured to receive the side supports 202, 204, 206, 208, in this exemplary embodiment, is greater than that of the notches defined by the deck rings 114, 116, 118, 120 and configured to receive the corner supports 102, 104, 106, 108 of the pallet 100 described above with reference to FIGS. 1-3. Accordingly, like the deck rings 114, 116, 118, 120 of the pallet 100 described above with reference to FIGS. 1-3, each deck ring 214, 216, 218, 220 in this exemplary embodiment also define eight separate notches which extend transverse to the curvature of the deck ring 214, 216, 218, 220. The first central support 210 and the second central support 212 are of similar construction to the first central connector 122 and the second central connector 124 of the pallet 100 described above with reference to FIGS. 1-3, except that the height of the first central support 210 and the second central support 212 is increased to be of equal height to both the side supports 202, 204, 206, 208 and the middle supports 110, 112 of the pallet 200. Accordingly, in this exemplary embodiment, each central support 210, 212 defines five separate notches.

Referring still to FIGS. 4 and 5, the pallet 200 in this exemplary embodiment is assembled in similar fashion as the pallet 100 described above with reference to FIGS. 1-3. In this regard: the supports 110, 112, 202, 204, 206, 208, 210, 212 are interlocked with the deck rings 214, 216, 218, 220 by aligning notches defined by the supports 110, 112, 202, 204, 206, 208, 210, 212 with corresponding notches defined by the deck rings 214, 216, 218, 220 and press fitting the supports 110, 112, 202, 204, 206, 208, 210, 212 and the deck rings 214, 216, 218, 220 together; and the deck rings 214, 216, 218, 220 are interlocked with each other by aligning corresponding notches defined by overlapping deck rings and press fitting the overlapping deck rings together. Unlike the pallet 100 described above with reference to FIGS. 1-3, however, in assembling the pallet 200 in this exemplary embodiment, two of the supports are interlocked with each other. Specifically, the first central support 210 and the second central support 212 are interlocked by aligning notches defined by the first central support 210 with corresponding notches defined by the second central support 212 and press fitting the first central support 210 and the second central support 212 together. Accordingly, like the pallet 100 described above with reference to FIGS. 1-3, the pallet 200 in this exemplary embodiment can also be fully assembled by press fitting and without the use of fasteners (screws, nails, staples, and the like) or adhesives, while still being as structurally strong as a traditional wooden pallet.

To ensure the various components of the pallet 200 that are interlocked together are closely fitted (or "snug"), it is generally preferred that the width of each notch defined by the supports 110, 112, 202, 204, 206, 208, 210, 212 and the deck rings 214, 216, 218, 220 is smaller than the thickness of the portion of the component or components intended to be received in the notch. For example, in some embodiments, the width of each notch may be approximately 10% smaller than the thickness of the portion of the component or the combined thickness of the components intended to be received therein. As the notches defined by the supports 110, 112, 202, 204, 206, 208, 210, 212 and the deck rings 214, 216, 218, 220 are initially formed by removing a portion of the paper core or paper core section by which the notches are defined using known cutting, sawing, and/or punching means, it should be appreciated that the widths and depths of each respective notch in the pallet 200 can be easily modified to better accommodate certain applications or environments.

The interlocking arrangement facilitated by the corresponding notches of the supports 110, 112, 202, 204, 206, 208, 210, 212 and the deck rings 214, 216, 218, 220, in conjunction with the width of such notches, aids in limiting translational movement of: the deck rings 214, 216, 218, 220 relative to the supports 110, 112, 202, 204, 206, 208, 210, 212 with which they are interlocked; the deck rings 214, 216, 218, 220 relative to each other; and the central supports 210, 212 relative to each other while the pallet 200 is in use.

Referring still to FIGS. 4 and 5, to provide a level surface across the entirety of the top of the pallet 200 upon which goods in need of transport can rest, in this exemplary embodiment, the top surface 110*a*, 112*a*, 202*a*, 204*a*, 206*a*, 208*a*, 210*a*, 212*a*, 214*a*, 216*a*, 218*a*, 220*a* of each respective component of the pallet 200 described above (i.e., the supports 110, 112, 202, 204, 206, 208, 210, 212 and the deck rings 214, 216, 218, 220) is coplanar with (i.e., reside along substantially the same plane as) the top surface 110*a*, 112*a*, 202*a*, 204*a*, 206*a*, 208*a*, 210*a*, 212*a*, 214*a*, 216*a*, 218*a*, 220*a* of the other components of the pallet 200 and is a flat surface. To permit the top surface 110*a*, 112*a*, 202*a*, 204*a*, 206*a*, 208*a*, 210*a*, 212*a*, 214*a*, 216*a*, 218*a*, 220*a* of these components to reside along a common plane when the pallet 200 is assembled, in this exemplary embodiment: each notch defined by one of the deck rings 214, 216, 218, 220 extends approximately 50% of the height of the deck ring defining the notch; and each notch defined by one of the supports 110, 112, 202, 204, 206, 208, 210, 212 extends approximately 21% of the height of the support defining the notch.

Referring still to FIGS. 4 and 5, in this exemplary embodiment, the respective components of the pallet 100 are of the dimensions specified in Table 2 below.

TABLE 2

| PALLET COMPONENT | HEIGHT | OUTER DIAMETER | ARC LENGTH | THICK-NESS |
|---|---|---|---|---|
| Side Supports (202, 204, 206, 208) | 7 inches | 24 inches | approx. 25 inches (120° central angle) | 0.75 inches |

TABLE 2-continued

| PALLET COMPONENT | HEIGHT | OUTER DIAMETER | ARC LENGTH | THICK-NESS |
|---|---|---|---|---|
| Middle Supports (110, 112) | 7 inches | 3 inches | — | 0.75 inches |
| Central Supports (210, 212) | 7 inches | 24 inches | approx. 25 inches (120° central angle) | 0.75 inches |
| Deck Rings (214, 216, 218, 220) | 3 inches | 24 inches | — | 0.75 inches |

Referring still to FIGS. 4 and 5, the assembled pallet 200, in this exemplary embodiment, has dimensions of 40 inches×48 inches×7 inches and provides a 4 inch clearance under the deck rings 214, 216, 218, 220 and two 12-inch-wide channels 222, 224 for each fork of a fork lift or similar lifting device. Of course, as evidenced by the pallet 100 described above with reference to FIGS. 1-3 and the pallet 300 described below with reference to FIG. 6, the dimensions and/or number of supports may vary from that described above with reference to FIGS. 4 and 5 to better accommodate different applications and/or environments without departing from the spirit or scope of the present invention. One of ordinary skill in the art will thus appreciate that, in instances where the dimensions of the supports and/or deck rings vary from that described above with reference to FIGS. 4 and 5, the extent to which the above-notches defined by the supports 110, 112, 202, 204, 206, 208, 210, 212 and/or deck rings 214, 216, 218, 220 extend along the height of such components may vary from that described above without departing from the spirit and scope of the present invention.

Figure 6:
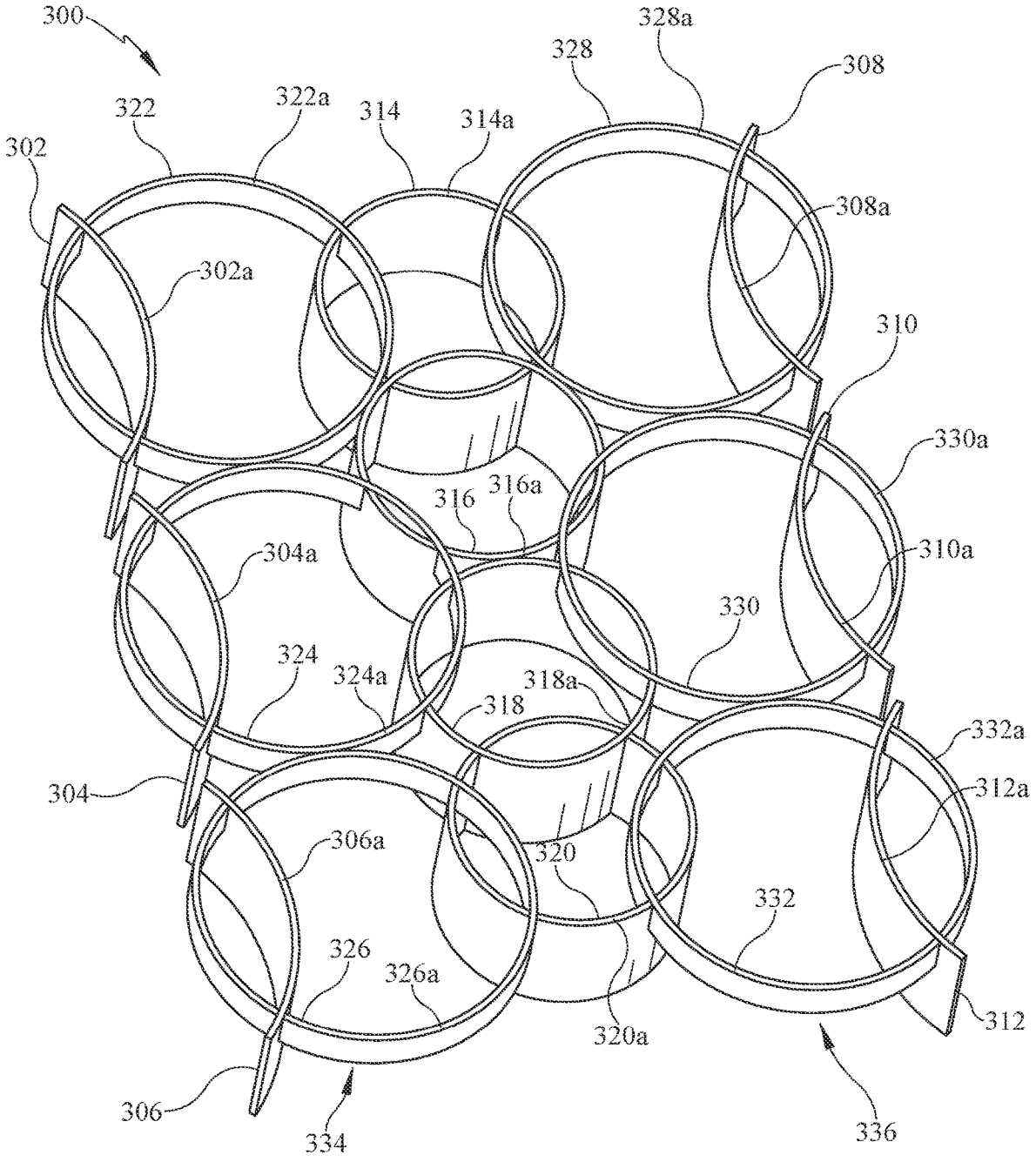
FIG. 6 is a perspective view of another exemplary pallet made in accordance with the present invention.

FIG. 6 shows a perspective view of another exemplary pallet 300 made in accordance with the present invention. In this exemplary embodiment, the pallet includes a total of ten supports which define a base of the pallet 300; and six deck rings, which are interlocked with the ten supports, and which define a surface of the pallet 300 upon which goods in need of transport can be stacked. Like the pallets 100, 200 described with reference to FIGS. 1-5, in this exemplary embodiment, the supports 302, 304, 306, 308, 310, 312, 314, 316, 318, 320 are also spaced as to define two channels 334, 336 configured to receive the forks of a lifting device, such as a fork lift, a pallet jack, a front loader, erect crane, or the like. Further like the pallets 100, 200 described with reference to FIGS. 1-5, the supports 302, 304, 306, 308, 310, 312, 314, 316, 318, 320 in this exemplary embodiment are also configured to support the deck rings 322, 324, 326, 328, 330, 332 in an elevated and upright position above a ground surface 50 (FIG. 3) when the supports 302, 304, 306, 308, 310, 312, 314, 316, 318, 320 are resting on the ground surface 50, such that a longitudinal axis (not shown) of each deck ring 322, 324, 326, 328, 330, 332 is perpendicular to the ground surface 50. In this regard, the deck rings 322, 324, 326, 328, 330, 332 are of a shorter height than the supports 302, 304, 306, 308, 310, 312, 314, 316, 318, 320. The supports 302, 304, 306, 308, 310, 312, 314, 316, 318, 320 and the deck rings 322, 324, 326, 328, 330, 332 are each a paper core or a section of a paper core. As such, like the pallets 100, 200 described above with reference to FIGS. 1-5, the pallet 300 in this exemplary embodiment also provides a more environmentally friendly and cost-effective alternative to known pallet constructions.

Referring still to FIG. 6, in this exemplary embodiment, the ten supports defining the base of the pallet 300 include:

a first support 302, a second support 304, and a third support positioned on a first side of the pallet 300; a fourth support 308, a fifth support 310, and a sixth support 312 positioned on a second side of the pallet 300; and a seventh support 314, an eighth support 316, a ninth support 318, and a tenth support 320 positioned between the first side and the second side of the pallet 300. Accordingly, the first support 302, the second support 304, the third support 306, the fourth support 308, the fifth support 310, and the sixth support 312 may also be characterized as "side supports," while the seventh support 314, the eighth support 316, the ninth support 318, and the tenth support 320 may also be characterized as "middle supports."

Referring still to FIG. 6, the side supports 302, 304, 306, 308, 310, 312 of the pallet 300 are sections taken from a paper core and, more specifically, arc sections taken from a larger paper core. In this regard, the side supports 302, 304, 306, 308, 310, 312 are thus of similar construction to the side supports 202, 204, 206 208 of the pallet 200 described above with reference to FIGS. 4 and 5. In this regard, each side support 302, 304, 306, 308, 310, 312 defines a pair of notches for receiving one of the deck rings 322, 324, 326, 328, 330, 332 therein. As evidenced by comparing FIG. 6 with FIGS. 4 and 5, the side supports 302, 304, 306, 308, 310, 312 in this exemplary embodiment are, however, of a greater arc length than the side supports 202, 204, 206, 208 of the pallet 200 in FIGS. 4 and 5.

Referring still to FIG. 6, the middle supports 314, 316, 318, 320 are paper cores and are of similar construction to the middle supports, 110, 112 of the pallet 100 described above with reference to FIGS. 1-3. In this regard, each middle support 314, 316, 318, 320 defines two pairs of notches, where one pair is configured to receive one of the deck rings 322, 324, 326, 328, 330, 332 and the other pair is configured to receive another one of the deck rings 322, 324, 326, 328, 330, 332. In this exemplary embodiment, the spacing of the two pairs of notches defined by each middle support 314, 316, 318, 320 for receiving two of the deck rings are spaced apart as to facilitate the interlocking of the two deck rings with the middle support 314, 316, 318, 320 without such deck rings overlapping with each other. As shown, in this exemplary embodiment, each middle support 314, 316, 318, 320 is also interlocked with another middle support 314, 316, 318, 320 of the pallet 300. To this end, in this exemplary embodiment, the seventh support 314 defines an additional pair of notches (meaning the seventh support defines a total of six notches) for receiving the eighth support 316 and the eighth support defines an additional pair of notches (meaning the eighth support defines a total of six notches) for receiving the seventh support 314. Similarly, the ninth support 318 defines an additional pair of notches (meaning the ninth support 318 defines a total of six notches) for receiving the tenth support 320 and the tenth support 320 defines an additional pair of notches (meaning the tenth support 320 defines a total of six notches) for receiving the ninth support 318. As evidenced by comparing FIG. 6 with FIGS. 1 and 2, the middle supports 314, 316, 318, 320 of the pallet 300 in this exemplary embodiment are of a larger diameter than the middle supports 110, 112 of the pallet 100 shown in FIGS. 1 and 2.

Referring still to FIG. 6, the deck rings of the pallet 300 include: a first deck ring 322; a second deck ring 324; a third deck ring 326; a fourth deck ring 328; a fifth deck ring 330; and a sixth deck ring 332. The deck rings 322, 324, 326, 328, 330, 332 are of similar construction to the deck rings 114, 116, 118, 120, 214, 216, 218, 220 of the pallets 100, 200 described above with reference to FIGS. 1-5, except that the deck rings 322, 324, 326, 328, 330, 332 in this exemplary embodiment do not each have eight notches defined therein. Rather, in this exemplary embodiment, the first deck ring 322, the third deck ring 326, the fourth deck ring 328, and the sixth deck ring 332 each define two pairs of notches (i.e., four notches in total): a first pair of notches for receiving the first support 302, the third support 306, the fourth support 308, or the sixth support 312; and a second pair of notches for receiving the seventh support 314 or the tenth support 320. In this exemplary embodiment, the second deck ring 324 and the fifth deck ring 330 define three pairs of notches (i.e., six notches in total): a first pair of notches for receiving the second support 304 or the fifth support 310; a second pair of notches for receiving the eighth support 316; and a third pair of notches for receiving the ninth support 318. As with the pallets 100, 200 described above with reference to FIGS. 1-5, in this exemplary embodiment, each notch defined by the various components of the pallet 300 extend transverse to the curvature of the component by which the notch is defined to enable the deck rings 322, 324, 326, 328, 330, 332 to be supported in an upright position, such that the longitudinal axes of the deck rings 322, 324, 326, 328, 330, 332 is perpendicular to the ground surface 50 (FIG. 50) when the supports 302, 304, 306, 308, 310, 312, 314, 316, 318, 320 are resting on the ground surface 50.

Referring still to FIG. 6, in one exemplary method of assembly, the pallet 300 is assembled by first positioning the supports 302, 304, 306, 308, 310, 312, 314, 316, 318, 320 in spaced relation as to define a first channel 334 in which a first fork of a lifting device can be received and a second channel 336 in which a second fork of a lifting device can be received. In this regard, the first support 302, the second support 304, and the third support 306 are aligned lengthwise as shown in FIG. 6 to establish a first side of the base of the pallet 300. The fourth support 308, the fifth support 310, and the sixth support 312 are similarly arranged lengthwise to establish a second side of the base of the pallet 300. To establish the central portion of the base of the pallet 300, the seventh support 314 is interlocked with the eighth support 316 and the ninth support 318 is interlocked with the tenth support 320. The seventh support 314 is interlocked with the eighth support 316 by aligning the notches defined by the seventh support 314 for receiving the eighth support 316 with the corresponding notches defined by the eighth support 316 for receiving the seventh support 314 and press fitting the seventh support 314 and the eighth support 316 together. The ninth support 318 and the tenth support 320 are similarly interlocked by aligning the notches defined by the ninth support 318 for receiving the tenth support 320 with the corresponding notches defined by the tenth support 320 for receiving the ninth support 318 and press fitting the ninth support 318 and the tenth support 320 together. Once the seventh support 314 and the eighth support 316 are interlocked and the ninth support 318 and the tenth support 320 are interlocked, the seventh support 314, the eighth support 316, the ninth support 318, and the tenth support 320 are aligned between the side supports 302, 304, 306, 308, 310, 312 to complete the base of the pallet 300.

Referring still to FIG. 6, once the base of the pallet 300 is established, the deck rings 322, 324, 326, 328, 330, 332 can be interlocked with the supports 302, 304, 306, 308, 310, 312, 314, 316, 318, 320. In this regard, the first deck ring 322 is interlocked with the with the first support 302 by aligning the first pair of notches defined by the first deck ring 322 for receiving the first support 302 with the corresponding notches defined by the first support 302 for receiving the first deck ring 322 and press fitting the first support 302 and the first deck ring 322 together. The first deck ring 322 is interlocked with the seventh support 314 by aligning the second pair of notches defined by the first deck ring 322 with the corresponding notches defined by the seventh support 314 for receiving the first deck ring 322 and press fitting the first deck ring 322 and the seventh support 314 together. The fourth deck ring 328 is interlocked with the fourth support 308 by aligning the first pair of notches defined by the fourth deck ring 328 for receiving the fourth support 308 with the corresponding notches defined by the fourth support 308 for receiving the fourth deck ring 328 and press fitting the fourth deck ring 328 and the fourth support 308 together. The fourth deck ring 328 is interlocked with the seventh support 314 by aligning the second pair of notches defined by the fourth deck ring 328 for receiving the fourth deck ring 328 with the corresponding notches defined by the seventh support 314 for receiving the fourth deck ring 328 and press fitting the fourth deck ring 328 and the seventh support 314 together.

Referring still to FIG. 6, the second deck ring 324 is interlocked with the second support 304 by aligning the first pair of notches defined by the second deck ring 324 for receiving the second support 304 with the corresponding notches defined by the second support 304 for receiving the second deck ring 324 and press fitting the second deck ring 324 and the second support 304 together. The second deck ring 324 is interlocked with the eighth support 316 by aligning the second pair of notches defined by the second deck ring 324 for receiving the eighth support 316 with the corresponding notches defined by the eighth support 316 for receiving the second deck ring 324 and press fitting the second deck ring 324 and the eighth support 316 together. The second deck ring 324 is interlocked with the ninth support 318 by aligning the third pair of notches defined by the second deck ring 324 for receiving the ninth support 318 with the corresponding notches defined by the ninth support 318 for receiving the second deck ring 324 and press fitting the second deck ring 324 and the ninth support 318 together. The fifth deck ring 330 is interlocked with the fifth support 310 by aligning the first pair of notches defined by the fifth deck ring 330 for receiving the fifth support 310 with the corresponding notches defined by the fifth support 310 for receiving the fifth deck ring 330 and press fitting the fifth deck ring 330 and the fifth support 310 together. The fifth deck ring 330 is interlocked with the eighth support 316 by aligning the second pair of notches defined by the fifth deck ring 330 for receiving the eighth support 316 with the corresponding notches defined by the eighth support 316 for receiving the fifth deck ring 330 and press fitting the fifth deck ring 330 and the eighth support 316 together. The fifth deck ring 330 is interlocked with the ninth support 318 by aligning the third pair of notches defined by the fifth deck ring 330 for receiving the ninth support 318 with the corresponding notches defined by the ninth support 318 for receiving the fifth deck ring 330 and press fitting the fifth deck ring 330 and the ninth support 318 together.

Referring still to FIG. 6, the third deck ring 326 is interlocked with the with the third support 306 by aligning the first pair of notches defined by the third deck ring 326 for receiving the third support 306 with the corresponding notches defined by the third support 306 for receiving the third deck ring 326 and press fitting the third deck ring 326 and the third support 306 together. The third deck ring 326 is interlocked with the tenth support 320 by aligning the second pair of notches defined by the third deck ring 326 for receiving the tenth support 320 with the corresponding notches defined by the tenth support 320 for receiving the third deck ring 326 and press fitting the third deck ring 326 and the tenth support 320 together. The sixth deck ring 332 is interlocked with the sixth support 312 by aligning the first pair of notches defined by the sixth deck ring 332 for receiving the sixth support 312 with the corresponding notches defined by the sixth support 312 for receiving the sixth deck ring 332 and press fitting the sixth deck ring 332 and the sixth support 312 together. The sixth deck ring 332 is interlocked with the tenth deck ring 320 by aligning the second pair of notches defined by the sixth deck ring 332 for receiving the tenth support 320 with the corresponding notches defined by the tenth support 320 for receiving the sixth deck ring 332 and press fitting the sixth deck ring 332 and the tenth support 320 together. The notches defined by the supports 302, 304, 306, 308, 310, 312, 314, 316, 318, 320 and the deck rings 322, 324, 326, 328, 330, 332 can be established by removing a portion of the paper core defining such components using known cutting, sawing, and/or punching means.

One of ordinary skill in the art, will appreciate that, in assembling the pallet 300, the various components of the pallet 300 may be interlocked together in a different order than that discussed above. Indeed, except where context precludes otherwise, the various components of the pallet 300 can be assembled in any order by aligning the corresponding notches defined by corresponding components of the pallet 300 and press fitting such components together.

Referring now again to FIG. 6, like the pallets 100, 200 described above with reference to FIGS. 1-5, in the pallet 300 in this exemplary embodiment can also be fully assembled by press fitting and without the use of fasteners (screws, nails, staples, and the like) or adhesives, while still being as structurally strong as a traditional wooden pallet. To ensure the various components of the pallet 300 that are interlocked together are closely fitted (or "snug"), it is generally preferred that the width of each notch defined by the supports 302, 304, 306, 308, 310, 312, 314, 316, 318, 320 and the deck rings 322, 324, 326, 328, 330, 332 is smaller than the thickness of the portion of the component or components intended to be received in the notch. For example, in some embodiments, the width of each notch may be approximately 10% smaller than the thickness of the portion of the component or the combined thickness of the components intended to be received therein. As the notches defined by the supports 302, 304, 306, 308, 310, 312, 314, 316, 318, 320 and the deck rings 322, 324, 326, 328, 330, 332 are initially formed by removing a portion of the paper core or paper core section by which the notches are defined using known cutting, sawing, and/or punching means, it should be appreciated that the widths and depths of each respective notch in the pallet 300 can be easily modified to better accommodate certain applications or environments.

The interlocking arrangement facilitated by the corresponding notches of the supports 302, 304, 306, 308, 310, 312, 314, 316, 318, 320 and the deck rings 322, 324, 326, 328, 330, 332, in conjunction with the width of such notches, aids in limiting translational movement of: the deck rings 322, 324, 326, 328, 330, 332 relative to the supports 302, 304, 306, 308, 310, 312, 314, 316, 318, 320 with which they are interlocked; and the middle supports 314, 316, 318, 320 relative to each other while the pallet 300 is in use.

Referring still to FIG. 6, to provide a level surface across the entirety of the top of the pallet 300 upon which goods in need of transport can rest, in this exemplary embodiment, the supports 302, 304, 306, 308, 310, 312, 314, 316, 318, 320 are of equal height and the deck rings 322, 324, 326, 328, 330, 332 are of equal height. Further to this end, in this exemplary embodiment, the respective components of the pallet 300 are preferably interlocked such that a top surface 302*a*, 304*a*, 306*a*, 308*a*, 310*a*, 312*a*, 314*a*, 316*a*, 318*a*, 320*a*, 322*a*, 324*a*, 326*a*, 328*a*, 330*a*, 332*a* of each respective component of the pallet 300 described above (i.e., the supports 302, 304, 306, 308, 310, 312, 314, 316, 318, 320 and deck rings 322, 324, 326, 328, 330, 332) is coplanar with (i.e., reside along substantially the same plane as) the top surface 302*a*, 304*a*, 306*a*, 308*a*, 310*a*, 312*a*, 314*a*, 316*a*, 318*a*, 320*a*, 322*a*, 324*a*, 326*a*, 328*a*, 330*a*, 332*a* of the other components of the pallet 300 and is a flat surface. To permit the top surface 302*a*, 304*a*, 306*a*, 308*a*, 310*a*, 312*a*, 314*a*, 316*a*, 318*a*, 320*a*, 322*a*, 324*a*, 326*a*, 328*a*, 330*a*, 332*a* of these components to reside along a common plane when the pallet 300 is assembled, in this exemplary embodiment: each notch defined by one of the deck rings 322, 324, 326, 328, 330, 332 extends approximately 50% of the height of the deck ring defining the notch; and each notch defined by one of the supports 302, 304, 306, 308, 310, 312, 314, 316, 318, 320 extends approximately 21% of the height of the support defining the notch.

Referring still to FIG. 6, in this exemplary embodiment, the respective components of the pallet 300 are of the dimensions specified in Table 3 below.

TABLE 3

| PALLET COMPONENT | HEIGHT | OUTER DIAMETER | ARC LENGTH | THICK-NESS |
|---|---|---|---|---|
| Side Supports (302, 304, 306, 308, 310, 312) | 7 inches | 24 inches | approx. 25 inches (120° central angle) | 0.75 inches |
| Middle Supports (314, 316, 318, 320) | 7 inches | 4 inches | — | 0.75 inches |
| Deck Rings (322, 324, 326, 328, 330, 332) | 3 inches | 24 inches | — | 0.75 inches |

The assembled pallet 300, in this exemplary embodiment, has dimensions of 40 inches×48 inches×7 inches and provides a 4 inch clearance under the deck rings 322, 324, 326, 328, 330, 332 and two 12 inch wide channels 334, 336 for each fork of a fork lift or similar lifting device. Of course, as evidenced by the pallets 100, 200 described above with reference to FIGS. 1-5, the dimensions and/or number of supports may vary from that described above with reference to FIG. 6 to better accommodate different applications and/or environments without departing from the spirit or scope of the present invention. One of ordinary skill in the art will thus appreciate that, in instances where the dimensions of the supports and/or deck rings vary from that described above with reference to FIG. 6, the extent to which the above-notches defined by the supports 302, 304, 306, 308, 310, 312, 314, 316, 318, 320 and/or deck rings 322, 324, 326, 328, 330, 332 extend along the height of such components may vary from that described above without departing from the spirit and scope of the present invention.

To avoid excessive numbering within the drawings, the reference numerals corresponding to the notches defined by the supports and deck rings of the pallets 200, 300 described above with reference to FIGS. 4-6 have been omitted; however, one of skill in the art can easily discern the location of such notches by viewing the drawings in conjunction with the written description provided herein.

Although the interlocking of the deck rings of the exemplary pallets 100, 200, 300 with supports of the pallets 100, 200, 300 is primarily described herein as being facilitated, in part, by the deck rings defining a plurality of notches for receiving the supports, alternative embodiments in which the deck rings are not notched and are simply inserted into notches defined by the supports are also contemplated herein. In such embodiments, the notches of the supports configured to receive the deck rings may be of a length which permits the full height of the deck rings to be received within the notches.

One of ordinary skill in the art will recognize that additional embodiments and implementations are also possible without departing from the teachings of the present invention. This detailed description, and particularly the specific details of the exemplary embodiments and implementations disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A pallet, comprising:

a plurality of deck rings defining a surface of the pallet on which goods in need of transport can be stacked; and a plurality of supports defining a base of the pallet and interlocked with the plurality of deck rings, the plurality of supports being spaced to define one or more channels for receiving a fork of a lifting device and configured to support the plurality of deck rings in an elevated and upright position above a ground surface, such that a longitudinal axis of each deck ring of the plurality of deck rings is perpendicular to the ground surface when the plurality of supports are resting on the ground surface;

wherein each support of the plurality of supports and each deck ring of the plurality of deck rings is a paper core or a section of a paper core; and wherein each deck ring of the plurality of deck rings is interlocked with at least one support of the plurality of supports.

2. The pallet according to claim 1, wherein each support of the plurality of supports defines a plurality of notches for receiving one or more deck rings of the plurality of deck rings, each notch of the plurality of notches extending transverse to a curvature of the support.

3. The pallet according to claim 1, wherein each support of the plurality of supports defines at least two notches in which a single deck ring of the plurality of deck rings is received.

4. The pallet according to claim 1, wherein at least one support of the plurality of supports is interlocked with at least two deck rings of the plurality of deck rings.

5. The pallet according to claim 1, wherein each deck ring of the plurality of deck rings is interlocked with another deck ring of the plurality of deck rings.

6. The pallet according to claim 1, wherein each deck ring of the plurality of deck rings defines a plurality of notches for receiving at least one of a support of the plurality of supports, another deck ring of the plurality of deck rings, and a central connector configured to interconnect the deck ring to another deck ring of the plurality of deck rings, the connector being a paper core or a section of a paper core and having a height which is shorter than a height of the plurality of supports.

7. The pallet according to claim 6, wherein the plurality of notches defined by each deck ring of the plurality of deck rings extend transverse to a curvature of the deck ring.

8. The pallet according to claim 6, wherein each notch of the plurality of notches defined by each deck ring of the plurality of deck rings is vertically positioned relative to another notch defined by one of a support of the plurality of supports, another deck ring of the plurality of deck rings, and a connector.

9. The pallet according to claim 1, and further comprising:

one or more central connectors centrally positioned about the pallet and interlocked with multiple deck rings of the plurality of deck rings, wherein the one or more central connectors have a height which is shorter than a height of the plurality of supports and each of the one or more central connectors is a paper core or a section of a paper core.

10. The pallet according to claim 9, wherein each central connector of the one or more central connectors is interlocked with each deck ring of the plurality of deck rings.

11. The pallet according to claim 9, wherein the one or more central connectors comprises multiple central connectors, and wherein each central connector of the one or more central connectors is interlocked with another central connector of the one or more central connectors.

12. The pallet according to claim 9, wherein each central connector of the one or more central connectors defines a plurality of notches for receiving the multiple deck rings, each notch of the plurality of notches extending transverse to a curvature of the central connector.

13. The pallet according to claim 9, wherein at least one of a support of the plurality of supports and a central connector of the one or more central connectors defines a notch configured to receive two deck rings of the plurality of deck rings.

14. The pallet according to claim 1, wherein a top surface of each of the plurality of deck rings and each of the plurality of supports is coplanar.

15. The pallet according to claim 1, wherein the top surface of each of the plurality of deck rings and each of the plurality of supports is a flat surface.

16. The pallet according to claim 1, wherein the plurality of supports and the plurality of deck rings are interlocked together without the use of fasteners or adhesives.

17. The pallet according to claim 1 wherein the plurality of support members comprises at least one of a plurality of tubes and a plurality of arcs of equal height.

18. A pallet, comprising:

a plurality of deck rings defining a surface of the pallet on which goods in need of transport can be stacked; and a plurality of supports defining a base of the pallet and interlocked with the plurality of deck rings, the plurality of supports being spaced apart from each other to define one or more channels for receiving a fork of a lifting device and configured to support the plurality of deck rings in an elevated position above a ground surface;

wherein each support of the plurality of supports and each deck ring of the plurality of deck rings is a paper core or a section of a paper core;

wherein a top surface of each of the plurality of deck rings and each of the plurality of supports is coplanar; and wherein the top surface of each of the plurality of deck rings and each of the plurality of supports is a flat surface.

19. The pallet according to claim 18, wherein each support of the plurality of supports defines a first plurality of notches for receiving one or more deck rings of the plurality of deck rings, and wherein each deck ring of the plurality of deck rings defines a second plurality of notches for receiving one or more supports of the plurality of supports.

20. A method for constructing a pallet without fasteners, the method comprising:

positioning a first set of components to define a base of the pallet and one or more channels in which a fork of a lifting device can be received, with each component of the first set of components being a paper core or a section of a paper core; and interlocking a second set of components with the first set of components, such that a top surface of each of the first set of components and a top surface of each of the second set of components is coplanar, with each component of the second set of components being a paper core or a section of a paper core;

wherein each component of the first set of components is of a first height and each component of the second set of components is of a second height that is shorter than the first height; and wherein the top surface of each of the first set of components and the second set of components is a flat surface.

* * * * *